US009803541B2

(12) United States Patent
Andersson et al.

(10) Patent No.: US 9,803,541 B2
(45) Date of Patent: Oct. 31, 2017

(54) INTERNAL COMBUSTION ENGINE

(71) Applicant: VOLVO TRUCK CORPORATION, Göteborg (SE)

(72) Inventors: Arne Andersson, Mölnlycke (SE); Bincheng Jiang, Göteborg (SE); Staffan Lundgren, Hindås (SE)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 15/129,834

(22) PCT Filed: Mar. 28, 2014

(86) PCT No.: PCT/EP2014/000840
§ 371 (c)(1),
(2) Date: Sep. 28, 2016

(87) PCT Pub. No.: WO2015/144188
PCT Pub. Date: Oct. 1, 2015

(65) Prior Publication Data
US 2017/0167366 A1 Jun. 15, 2017

(51) Int. Cl.
*F02B 41/08* (2006.01)
*F02B 33/22* (2006.01)
(Continued)

(52) U.S. Cl.
CPC ..... *F02B 41/08* (2013.01); *F02B 33/02* (2013.01); *F02B 33/06* (2013.01); *F02B 33/18* (2013.01);
(Continued)

(58) Field of Classification Search
CPC ..... F02B 41/08; F02B 33/22; F02B 33/02; F02B 33/06; F02B 33/18
(Continued)

(56) References Cited

U.S. PATENT DOCUMENTS 967,828 A 8/1910 Pierson
3,623,463 A * 11/1971 De Vries ..... F02B 1/00 123/193.6
(Continued)

FOREIGN PATENT DOCUMENTS

DE 102010049513 A1 4/2012

OTHER PUBLICATIONS

International Search Report (dated Sep. 17, 2014) for corresponding International App. PCT/EP/2014/000840.

*Primary Examiner* — Mahmoud Gimie
(74) *Attorney, Agent, or Firm* — WRB-IP LLP

(57) ABSTRACT

An internal combustion engine includes a first low-pressure cylinder housing a first low-pressure piston, and a first high-pressure cylinder housing a first high-pressure piston, the first high-pressure cylinder being arranged in upstream fluid communication with the first low-pressure cylinder for providing exhaust gas into the first low-pressure cylinder. The internal combustion engine further includes a second low-pressure cylinder housing a second low-pressure piston, the second low-pressure cylinder being arranged in upstream fluid communication with the first high-pressure cylinder for providing compressed gas into the first high-pressure cylinder, and a second high-pressure cylinder housing a second high-pressure piston, the second high-pressure cylinder being arranged in downstream fluid communication with the first low-pressure cylinder for receiving compressed gas from the first low-pressure cylinder, and further arranged in upstream fluid communication with the second low-pressure cylinder for providing exhaust gas into the second low-pressure cylinder.

16 Claims, 5 Drawing Sheets

(51) Int. Cl.

| | |
|---|---|
| ***F02B 75/22*** | (2006.01) |
| ***F02B 75/02*** | (2006.01) |
| ***F02B 33/06*** | (2006.01) |
| ***F02B 33/02*** | (2006.01) |
| ***F02B 33/18*** | (2006.01) |

(52) U.S. Cl.
CPC ..... *F02B 33/22* (2013.01); *F02B 75/02* (2013.01); *F02B 75/225* (2013.01); *F02B 2075/025* (2013.01); *F02B 2075/027* (2013.01)

(58) Field of Classification Search
USPC ..... 123/70 R, 58.8, 257
See application file for complete search history.

(56) References Cited

U.S. PATENT DOCUMENTS

| | | | | |
|---|---|---|---|---|
| 4,159,700 | A * | 7/1979 | McCrum ..... | F02B 41/06 123/1 R |
| 6,318,310 | B1 | 11/2001 | Clarke | |
| 6,553,977 | B2 * | 4/2003 | Schmitz ..... | F02B 41/06 123/561 |
| 2011/0303202 | A1 | 12/2011 | Moser et al. | |
| 2013/0199492 | A1 | 8/2013 | Gopalakrishnan et al. | |

* cited by examiner

INTERNAL COMBUSTION ENGINE

BACKGROUND AND SUMMARY

The present invention relates to an internal combustion engine. The invention is applicable on vehicles, in particularly heavy vehicles, such as e.g. trucks. However, although the invention will mainly be described in relation to a truck, the internal combustion engine is of course also applicable for other type of vehicles, such as cars, industrial construction machines, wheel loaders, etc.

For many years, the demands on internal combustion engines have been steadily increasing and engines are continuously developed to meet the various demands from the market. Reduction of exhaust gases, increasing engine efficiency, i.e. reduced fuel consumption, and lower noise level from the engines are some of the criteria that becomes an important aspect when choosing vehicle engine.

Furthermore, in the field of trucks, there are applicable law directives that have e.g. determined the maximum amount of exhaust gas pollution allowable. Still further, a reduction of the overall cost of the vehicle is important and since the engine constitutes a relatively large portion of the total costs, it is natural that also the costs of engine components are reduced.

In order to meet the described demands, various engine concepts have been developed throughout the years where conventional power cylinders have been combined with e.g. a pre-compression stage and/or an expansion stage.

U.S. Pat. No. 967,828 disclose an internal combustion engine with an object of minimizing the number of cylinders and moving parts required to perform an engine cycle. The internal combustion engine in U.S. Pat. No. 967,828 comprises a high-pressure cylinder and a low-pressure cylinder, which are connected to each other by means of two conduits. The low-pressure cylinder is equipped to alternately perform the functions of a compressor and an expander. Hereby, the need of a separate compressor and a separate expander is reduced.

Although the internal combustion engine disclosed in U.S. Pat. No. 967,828 provides a relatively compact engine with less components in comparison to its prior art engines, it is still in need of further improvements in terms of e.g. power efficiency.

It is desirable to provide an internal combustion engine having increased power efficiency in relation to prior art engines.

According to a first aspect of the present invention there is provided an internal combustion engine comprising a first low-pressure cylinder housing a first low-pressure piston; and a first high-pressure cylinder housing a first high-pressure piston, the first high-pressure cylinder being arranged in upstream fluid communication with the first low-pressure cylinder for providing exhaust gas into the first low-pressure cylinder; wherein the internal combustion engine further comprises a second low-pressure cylinder housing a second low-pressure piston, the second low-pressure cylinder being arranged in upstream fluid communication with the first high-pressure cylinder for providing compressed gas into the first high-pressure cylinder; and a second high-pressure cylinder housing a second high-pressure piston, the second high-pressure cylinder being arranged in downstream fluid communication with the first low-pressure cylinder for receiving compressed gas from the first low-pressure cylinder, and further arranged in upstream fluid communication with the second low-pressure cylinder for providing exhaust gas into the second low-pressure cylinder.

The high-pressure cylinder is, according to an example embodiment, a combustion cylinder. The combustion cylinders may in an example embodiment, as will be described further below, be four-stroke combustion cylinders, i.e. they have one power stroke and one exhaust stroke for every two revolution of the second crank shaft. When the high-pressure piston in the respective combustion cylinders are travelling downwards, towards a bottom dead centre of the respective cylinder, compressed gas from the low-pressure cylinder is forced into the combustion cylinder. When the high-pressure piston thereafter is travelling upwards toward a top dead centre of the combustion cylinder, the gases in the combustion cylinder are compressed and ignited at a desired point in time. The high-pressure piston is thereafter, again, traveling downwards towards the bottom dead centre. Finally, when the high-pressure piston is travelling upwards, the exhaust gases are directed out from the combustion cylinders and in to the other one of the low-pressure cylinders. Combustion fuel is provided to the combustion cylinders in a fashion known to the person skilled in the art of four-stroke internal combustion engines and will not be discussed further. The invention is also not limited to any particular kind of fuel.

The low-pressure cylinders according to the present invention each has the dual functioning of operating both as a compression cylinder as well as an expansion cylinder.

A compression cylinder should in the following and throughout the entire description be interpreted as a cylinder which is arranged to provide compressed gases into the high-pressure cylinders. Accordingly, the low-pressure piston compresses gas inside the low-pressure cylinder, which compressed gas thereafter is provided to the intake of one of the high-pressure cylinders. The pressure level of the compressed gas is then above atmospheric pressure.

An expansion cylinder should in the following and throughout the entire description be interpreted as a cylinder which is arranged to receive exhaust gas from the high-pressure cylinder and thereafter further provide the exhaust gas out from the expansion cylinder.

Hereby, the first low-pressure cylinder is arranged to provide compressed gas which is directed to the second high-pressure cylinder. The second high-pressure cylinder executes a combustion cycle and directs exhaust gases into the second low-pressure cylinder where the exhaust gases are expanded. Likewise, the second low-pressure cylinder is arranged to provide compressed gas which is directed to the first high-pressure cylinder. The first high-pressure cylinder executes a combustion cycle and directs the exhaust gases into the first low-pressure cylinder where the exhaust gases are expanded. The exhaust gases may, after being expanded in the first and second low-pressure cylinder, be directed to e.g. some sort of gas after treatment system, such as a catalyst or the like.

Accordingly, the first low-pressure cylinder is acting as a compression cylinder when providing compressed gas into the second high-pressure cylinder, and acting as an expansion cylinder when receiving exhaust gas from the first high-pressure cylinder. Likewise, the second low-pressure cylinder is acting as a compression cylinder when providing compressed gas into the first high-pressure cylinder, and acting as an expansion cylinder when receiving exhaust gas from the second high-pressure cylinder.

Furthermore, the wording "fluid communication" should not be construed as limited to a specific fluid, or state of a fluid. The fluid may for example be in a gas-phase, or a liquid-phase.

The present invention is based on the insight that by arranging a low-pressure cylinder to function as a compression cylinder for one of the high-pressure cylinders, and as an expansion cylinder for the other one of the high-pressure cylinders, a compact cylinder arrangement is provided in which a reduction of dead volume in the low-pressure cylinders can be provided since the low-pressure cylinders will receive exhaust gases which are already pressurized from a compression stage.

Furthermore, another advantage of the present invention is that the low-pressure cylinders can function as compression cylinders as well as expansion cylinders without the need of a dual-acting piston, since both the compression and the expansion takes place in the volume which is delimited by the cylinder liner and the upper portion of the piston reciprocating within the cylinder.

According to an example embodiment, the first and second low-pressure pistons may operate in a two-stroke configuration and the first and second high-pressure pistons may operate in a four-stroke configuration. According to an example embodiment, the first and second low-pressure pistons may be connected to a first crank shaft and the first and second high-pressure pistons may be connected to a second crank shaft, wherein the second crank shaft is configured to rotate with a speed of at least twice the speed of the first crank shaft.

Hereby, when the second crank shaft rotates with a speed twice the speed of the first crank shaft, the four-stroke high-pressure pistons completes a full combustion cycle, which is 720 crank angle degrees, when the low-pressure pistons completes a full two-stroke cycle, which is 360 crank angle degrees. To transfer the torque from the first crank shaft and the second crank shaft to e.g. the gearbox transmission, and to synchronize the crank shafts, the first crank shaft may be connected to the second crank shaft by means of e.g. a suitable transmission. It should be readily understood that the wording "at least twice the speed" should be interpreted in such a way that the second crank shaft should rotate with a speed having a multiple integer of at least two.

According to an example embodiment, the first low-pressure piston and the second low-pressure piston may be arranged in a 180 degrees crank angle offset in relation to each other, such that the first low-pressure piston is configured to reach an upper end position within the first low-pressure cylinder when second low-pressure piston reaches a lower end position within the second low-pressure cylinder. Hereby, a continuous torque is provided. Also, the combustion process and expansion process will be relatively continuous which will result in an optimized combustion cycle.

According to an example embodiment, the first high-pressure piston and the second high-pressure piston may be positioned to reach an upper end position within the respective high-pressure cylinder approximately simultaneously and in such a way that the first high-pressure piston is configured to be ignited at an upper end position within the first high-pressure cylinder when the second high-pressure piston is in an upper end position within the second high-pressure cylinder for initiation of intake of fuel therein. Hereby, a well-balanced engine is provided which has a continuous engine torque.

According to an example embodiment, the first and second high-pressure pistons may be arranged to reach a lower end position within the respective first and second high-pressure cylinder when the first and second low-pressure pistons reaches an upper and a lower end position within the respective first and second low-pressure cylinder.

According to an example embodiment, the first and second low-pressure cylinders may be provided with liner intake ports at a lower end portion of the respective cylinders, such that gas can be provided into the respective low-pressure cylinder when the respective first and second low-pressure piston is positioned in their lower end position.

Hereby, at the beginning of the compression phase, gas is provided into the low-pressure cylinder when the low-pressure piston is positioned in a lower end position therein, i.e. at a bottom dead centre of the low-pressure cylinder. At this stage, the low-pressure piston receives "fresh" gas, e.g. ambient air, into the low-pressure cylinder via the liner intake ports, and at the same time, or approximately the same time, expanded combustion gases are evacuated from the low-pressure cylinder. Hereby, a scavenging effect of the cylinder is provided.

The present invention is however not limited to liner intake ports at the lower end position of the cylinder, the invention works equally as well with ports located in e.g. the cylinder head of the low-pressure cylinder, such that "fresh" gas is received from an upper portion of the cylinders instead of the lower portion.

According to an example embodiment, the first low-pressure cylinder may be in fluid communication with the second high-pressure cylinder by means of a first passageway. According to an example embodiment, the second low-pressure cylinder may be in fluid communication with the first high-pressure cylinder by means of a second passageway. According to an example embodiment, each one of the first and second passageways may be provided with cooling means for cooling the fluid passing there through. By means of the cooling means, the power consumption of e.g. the compression cylinder can be reduced, since the pressure level of the cooling means can be increased in comparison to previously known engines.

Further, the total compression work will be reduced. A colder internal combustion engine is also provided. The cooling means may e.g. be a heat exchanger or the like. Still further, in a conventional two-stroke combustion engine, the temperature of the residual gases from the combustion process is relative high which results in additional compression work and increased energy losses in terms of increased cooling losses. However, with the cooling means of the present invention, the residual gases from the scavenging process in the low-pressure cylinder are cooled before entering the combustion cylinder thus solving the problem arising in conventional engines.

According to an example embodiment, the first high-pressure cylinder may be in fluid communication with the first low-pressure cylinder by means of a third passageway. According to an example embodiment, the second high-pressure cylinder may be in fluid communication with the second low-pressure cylinder by means of a fourth passageway.

According to an example embodiment, each of the high-pressure cylinders may comprise valved inlet ports and valved outlet ports for controlling fluid transportation into and out from the respective high-pressure cylinders. According to an example embodiment, each of the low-pressure cylinders may comprise valved outlet ports arranged to control fluid transportation out from the respective low-pressure cylinders.

It should be noted that the low-pressure cylinders may not need valved inlet ports, or the like, at the passage where combustion gases are provided from the respective high-pressure cylinders. Hence, the low-pressure cylinders may, according to the example embodiment, comprise valved outlet ports for the passage to the high-pressure cylinders as well as to the surrounding where the low-pressure cylinders discharges the expanded exhaust gases.

Due to the different speed of the crank shafts for the different cylinders, one common cam shaft may be sufficient to use, since the cam shaft for a two-stroke cylinder should run at the speed of the two-stroke crank shaft and the cam shaft for the four-stroke cylinders should run with a speed of half the speed of the four-stroke crank shaft. Hereby, due to the speed ratio between the first and second crank shafts described above, one common cam shaft may be enough to use. However, the present invention should not be construed as limited to only one cam shaft, the invention also functions properly by utilizing more than one cam, shaft, such as two or three cam shafts, etc.

According to a second aspect of the present invention, there is provided a vehicle comprising an internal combustion engine according to any one of the above described example embodiments.

Effects and features of this second aspect are largely analogous to those describe above in relation to the first aspect of the present invention.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional features and advantages of the present invention, will be better understood through the following illustrative and non-limiting detailed description of exemplary embodiments of the present invention, wherein.

DETAIL DESCRIPTION

Figure 1:
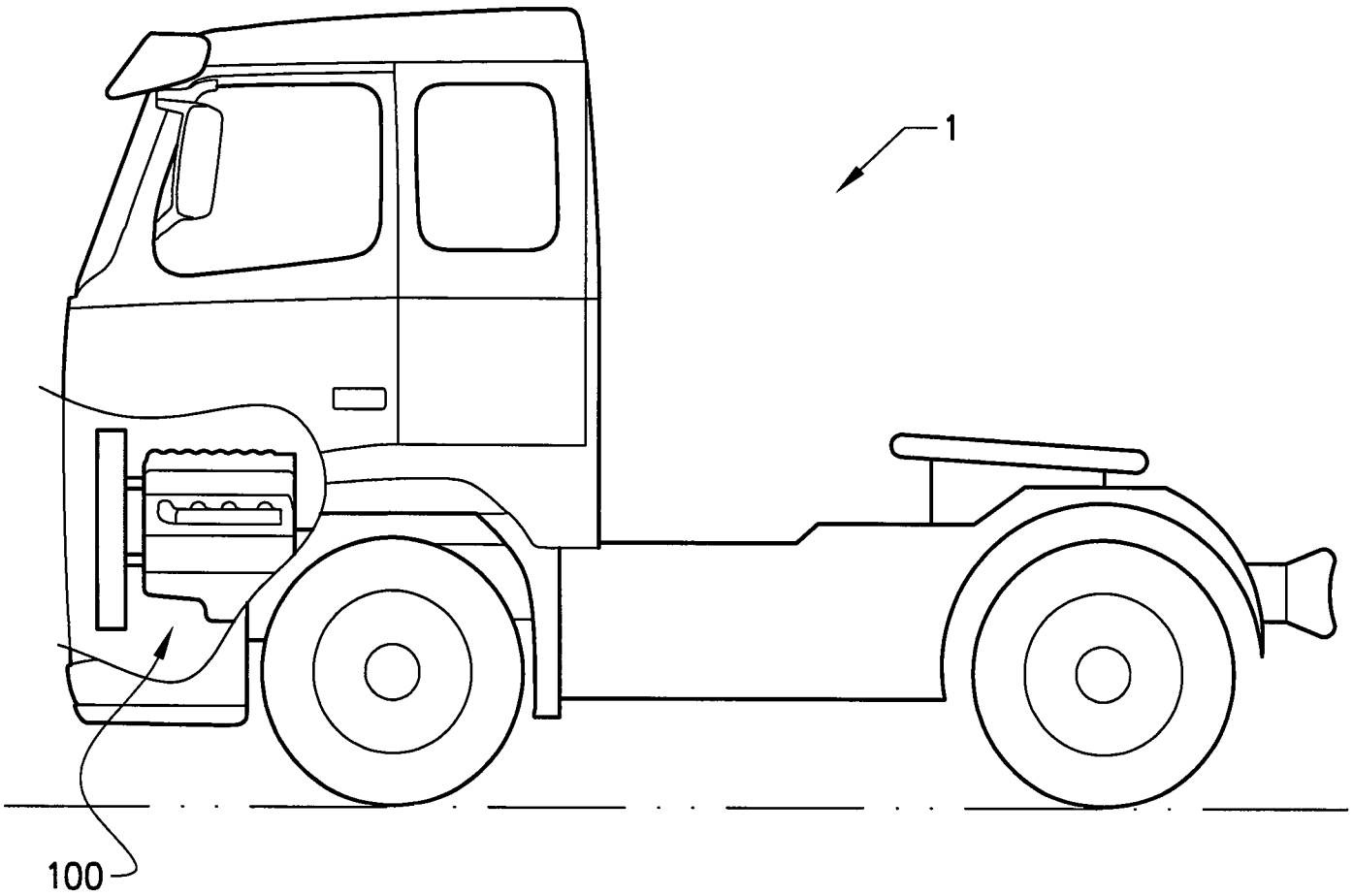
FIG. 1 is a side view of a vehicle comprising an internal combustion engine according to an example embodiment of the present invention.

The present invention will now be described more fully hereinafter with reference to the accompanying drawings, in which an exemplary embodiment of the invention is shown. The invention may, however, be embodied in many different forms and should not be construed as limited to the embodiment set forth herein; rather, the embodiment is provided for thoroughness and completeness. Like reference character refer to like elements throughout the description.

With particular reference to FIG. 1, there is provided a vehicle 1 with an internal combustion engine 100 according to the present invention. The vehicle 1 depicted in FIG. 1 is a truck for which the inventive internal combustion engine 100, which will be described in detail below, is particularly suitable for.

Figure 2:
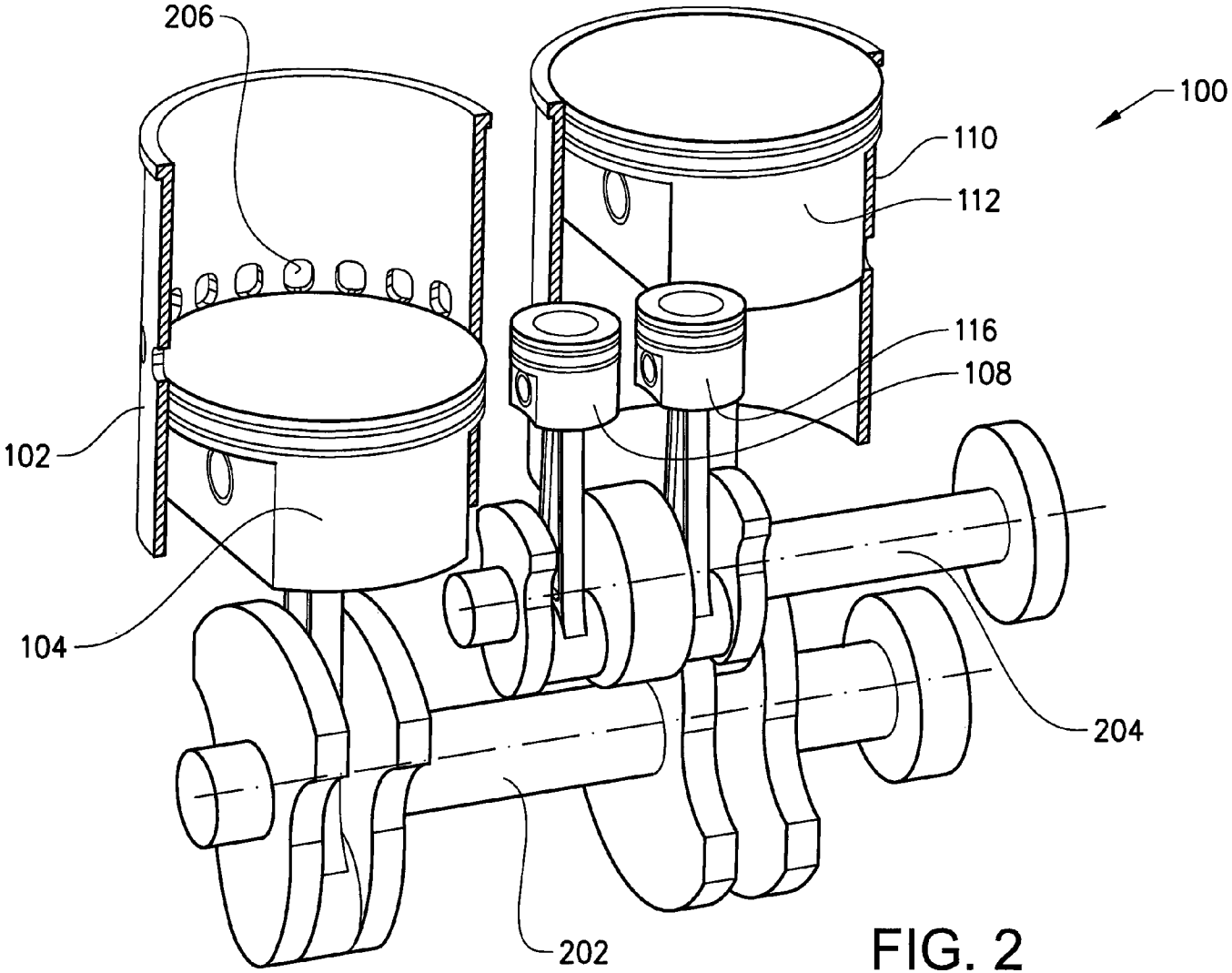
FIG. 2 is a perspective view of the internal combustion engine according to an example embodiment of the present invention.
Figure 3:
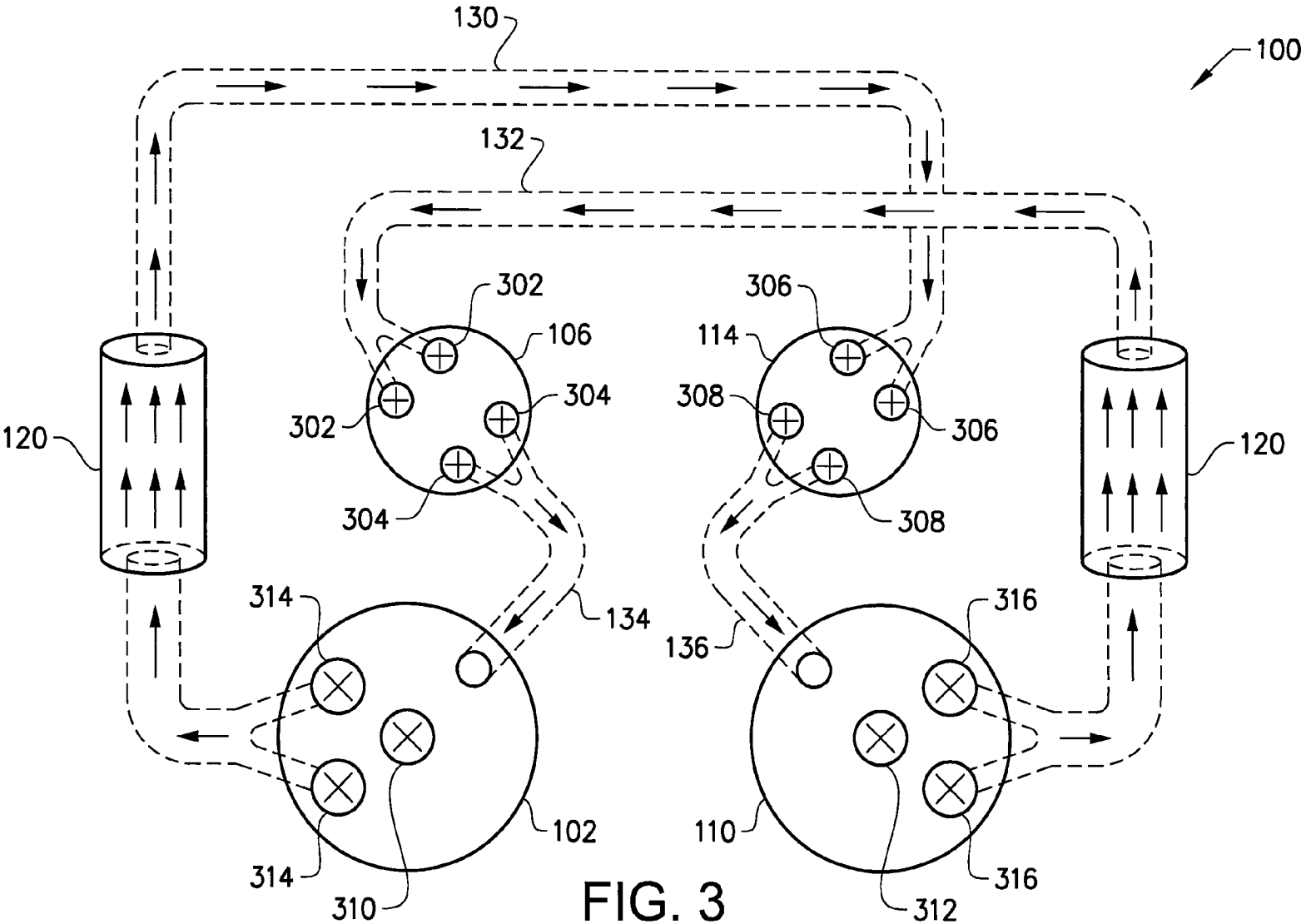
FIG. 3 is a schematic top view of the interconnection between the cylinders in the example embodiment depicted in FIG. 2.

Turning to FIG. 2 in combination with FIG. 3, which illustrate an internal combustion engine 100 according to an example embodiment of the present invention. A full illustration of the cylinders housing the respective pistons have been omitted from FIG. 2 for simplicity of understanding the invention and the piston configuration, and can instead be found in the schematic top view of FIG. 3.

The internal combustion engine 100 comprises a first low-pressure cylinder 102. The first low-pressure cylinder 102 is arranged in upstream fluid communication with a second high-pressure cylinder 114 by means of a first passageway 130. The first passageway comprises a cooling means 120 positioned in fluid communication between the first low-pressure cylinder 102 and the second high-pressure cylinder 114 and arranged to cool the compressed gases directed from the first low-pressure cylinder 102 to the second high-pressure cylinder 114. Furthermore, the second high-pressure cylinder 114 is further arranged in upstream fluid communication with a second low-pressure cylinder 110 by means of a fourth passageway 136. The second low-pressure cylinder 110 is in turn arranged in upstream fluid communication with a first high-pressure cylinder 106 by means of a second passageway 132. The second passageway also comprises a cooling means 120 positioned in fluid communication between the second low-pressure cylinder 110 and the first high-pressure cylinder 06 and arranged to cool the compressed gases directed from the second low-pressure cylinder 110 to the first high-pressure cylinder 106. Finally, the first high-pressure cylinder 106 is arranged in upstream fluid communication with the first low-pressure cylinder 102 by means of a third passageway 134.

The cooling means 120 may be any suitable arrangement that can cool the fluid passing there through, such as e.g. a heat exchanger or the like.

Furthermore, the first 102 and the second 110 low-pressure cylinders houses a first 104 and a second 112 low-pressure piston, respectively, which are both connected to a first crank shaft 202 by means of a respective connecting rod. The first 106 and the second 114 high-pressure cylinders houses a first 108 and a second 116 high-pressure piston, respectively, which are both connected to a second crank shaft 204 by means of a respective connecting rod.

Moreover, the second crank shaft 204 is, in the example embodiment, configured to rotate with a speed of a multiple integer of at least two in comparison to the first crank shaft 202. The following will, for simplicity of understanding, only describe the case where the second crank shaft 204 rotates with twice the speed of the first crank shaft 202. Also, according to the example embodiment, the first 102 and second 110 low-pressure cylinders are two-stroke cycle cylinders, while the first 06 and second 114 high-pressure cylinders are four-stroke cycle cylinders. Hereby, the low-pressure pistons 104, 112 will complete a full two-stroke cycle when the high-pressure pistons 108, 116 complete a full four-stroke cycle.

The first crank shaft 202 is connected to the second crank shaft 204 by means of a suitable transmission (not shown). The transmission may, for example, be a belt transmission or a gear transmission where each of the crank shafts comprises gears which are in meshed connection with each other. The engine torque is thereafter transmitted to e.g. a gearbox of the vehicle.

Furthermore, the high-pressure cylinders 106, 114 comprise inlet valves 302, 306 which are positioned in an open state when the high-pressure cylinders 106, 114 are configured to receive compressed gas from the respective low-pressure cylinders 102, 110. Also, the high-pressure cylinders 106, 14 comprise outlet valves 304, 308 which are positioned in an open state when the high-pressure cylinders 106, 114 are configured to discharge combustion gases to the respective low-pressure cylinders 102, 110. Moreover, the low-pressure cylinders 102, 110 comprises a respective discharge valve 310, 312 which are configured to be positioned in an open state when expanded exhaust gases in the respective low-pressure cylinders are configured to be discharged from the low-pressure cylinder to, for example, a catalyst or the like. Further, both of the low-pressure cylinders 102, 110 also comprises outlet valves 314, 316 which are positioned in an open state when the respective low-pressure cylinders 102, 110 are arranged to provide compressed gas to the respective high-pressure cylinders 106, 114.

It should be noted that in the example embodiment depicted in FIG. 3, no valve is provided in the low-pressure cylinders 102, 110 in connection with the third 134 and fourth 116 passageways. However, the invention is equally applicable with the use of valves at these positions and the invention should hence not be construed as limited to the configuration depicted in FIG. 3. Also, FIG. 3 illustrates that the first high-pressure cylinder comprises two inlet valves 302 and two outlet valves 304. It should be readily understood that the present invention works equally as well with one inlet valve and one outlet valve. The same reasoning applies for the other cylinders as well where two inlet valves and/or two outlet valves are depicted.

In order to describe the motion pattern of the different cylinders and the communication between the different cylinders during use of the internal combustion engine, reference is made to FIGS. 4*a* to 4*d*, which illustrate a complete cycle of the internal combustion engine.

Figure 4A:
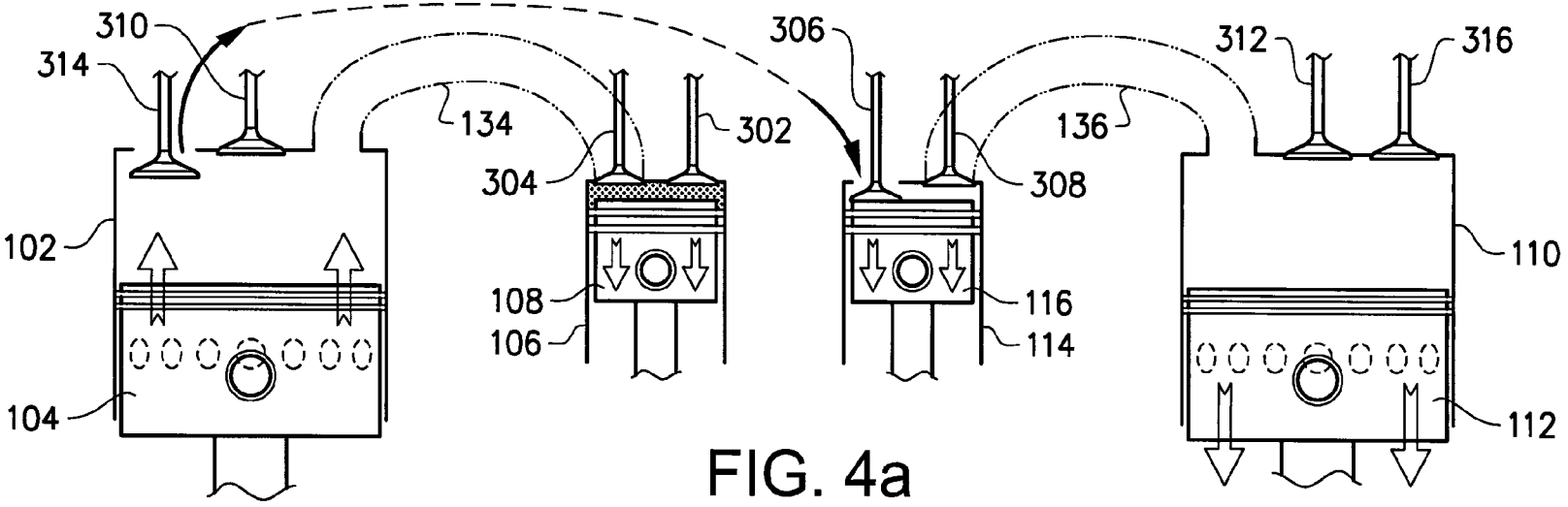
FIGS. 4*a*-4*d* schematically illustrates the four steps of a complete cycle of the internal combustion engine according to an example embodiment of the present invention.

Starting with FIG. 4*a*, which illustrates a first stage of the cycle, the first low-pressure piston 104 is positioned in a mid-portion of the first low-pressure cylinder 102 and in an upward motion towards the upper end position therein. Hereby, the first low-pressure cylinder 102 is in a compression state where gas arranged therein is exposed to compression. The outlet valve 314 of the first low-pressure cylinder is positioned in an open state to allow the compressed gas to be forced into the second high-pressure cylinder 114. Furthermore, the discharge valve 310 of the first low-pressure cylinder 102 is positioned in a closed state.

The first high-pressure piston 108 is positioned in an upper end position within the first high-pressure cylinder 106 and in a downward motion towards the lower end position therein. The inlet valve 302 and the outlet valve 304 are both positioned in a closed state and the first high-pressure cylinder 106 is in a power stroke, i.e. an ignition of the reduced volume within the first high-pressure cylinder takes place at this stage forcing the first high-pressure piston 108 downward towards the lower end position within the first high-pressure cylinder 106.

The second high-pressure piston 116 is positioned in an upper end position within the second high-pressure cylinder 114 and in a downward motion towards the lower end position therein. The inlet valve 306 of the second high-pressure cylinder 114 is positioned in an open state to allow compressed gas from the first low-pressure cylinder 102 to be received therein. Accordingly, compressed gas is provided into the second high-pressure cylinder 114 at this stage. Moreover, the outlet valve 308 of the second high-pressure cylinder 114 is positioned in a closed state to prevent gas from entering into the second low-pressure cylinder 110.

Finally, the second low-pressure piston 112 is positioned in a mid-portion of the second low-pressure cylinder 110 and in a downward motion towards the lower end position therein. The outlet valve 316 and the discharge valve 312 of the second low-pressure cylinder 110 are both positioned in a closed state.

Figure 4B:
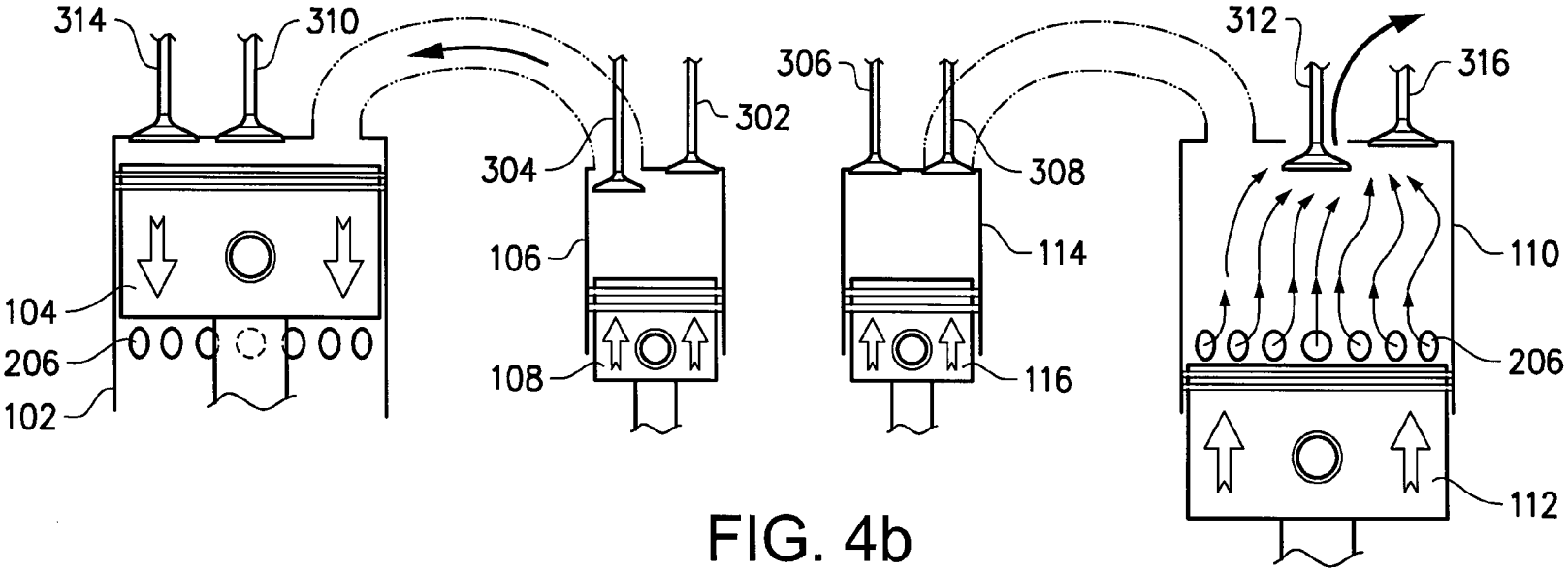

At a second stage of the cycle, illustrated in FIG. 4*b*, the first low-pressure piston 104 is positioned in the upper end position of the first low-pressure cylinder 102 and in a downward motion towards the lower end position therein. The outlet valve 314 and the discharge valve 310 of the first low-pressure cylinder 102 are both positioned in a closed state. The first low-pressure cylinder 102 is in this stage receiving combustion gas from the first high-pressure cylinder 106, which will be described further below. The first low-pressure cylinder 102 is in this second stage initiating an expansion phase and is thus acting as an expansion cylinder for the combustion gas received from the first high-pressure cylinder 106.

The first high-pressure piston 108 is positioned in the lower end position of the first high-pressure cylinder 106 and in an upward motion towards the upper end position therein. The outlet valve 304 of the first high-pressure cylinder 106 is positioned in an open state, thus forcing the combustion gases from the first high-pressure cylinder 106 into the first low-pressure cylinder 02 during the upward motion of the first high-pressure piston 108. Further, the inlet valve 302 of the first high-pressure cylinder 106 is positioned in a closed state.

The second high-pressure piston 116 is positioned in the lower end position of the second high-pressure cylinder 14 and in an upward motion towards the upper end position therein. The inlet valve 306 and the outlet valve 308 are both positioned in a closed state such that the compressed gas received from the first low-pressure cylinder 102 in the first stage depicted in FIG. 4*a* will be further compressed during the upward motion of the second high-pressure piston 116.

Moreover, the second low-pressure piston 112 is positioned in the lower end position within the second low-pressure cylinder 110 and in an upward motion towards the upper end position therein. The exhaust valve 312 of the second low-pressure cylinder 110 is positioned in an open state to allow expanded exhaust gas to be discharged from the second low-pressure cylinder 110. Also, the outlet valve 316 of the second low-pressure cylinder 10 is positioned in a closed state. Furthermore, the second low-pressure piston 112 is, as described, positioned in the lower end position of the second low-pressure cylinder 110. Hereby, the second low-pressure piston 112 is positioned below the liner intake ports 206 of the second low-pressure cylinder 110 thus allowing gas to enter into the second low-pressure cylinder 110. At this stage, the second low-pressure cylinder 110 is initiating a compression stage of the gas entering through the liner intake ports 206 and a scavenging process of the second low-pressure cylinder 110 is executed.

Figure 4C:
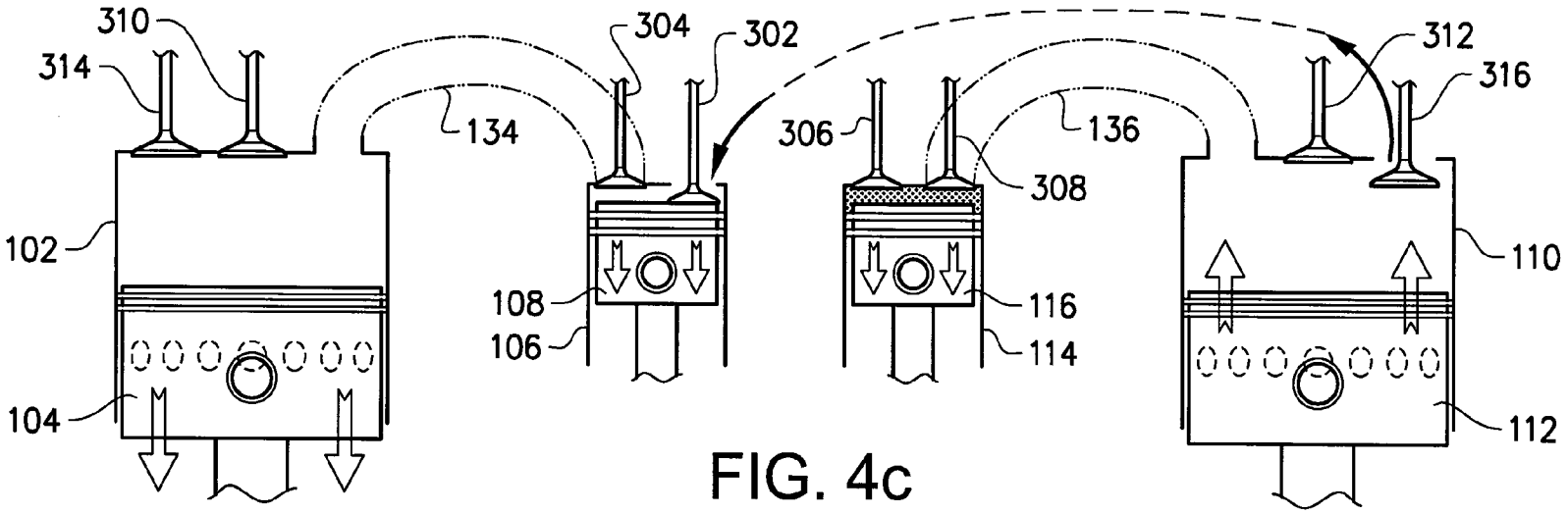

Turning now to FIG. 4*c*, illustrating the third stage of the cycle. The first low-pressure piston 104 is positioned in the mid-portion of the first low-pressure cylinder 102 and still in a downward motion towards the lower end position therein. Hereby, the exhaust gas entering the first low-pressure cylinder 102 in the second stage of the cycle is thus expanded further during this third stage of the cycle. The outlet valve 314 and the exhaust valve 310 of the first low-pressure cylinder 102 are both positioned in a closed state.

Furthermore, the first high-pressure piston 108 is positioned in an upper end position of the first high-pressure cylinder 106 and in a downward motion towards the lower end position therein. The inlet valve 302 of the first high-pressure cylinder 106 is positioned in an open state to allow compressed gas from the second tow-pressure cylinder 110 to be received therein. Accordingly, compressed gas is provided into the first high-pressure cylinder 106 from the second low-pressure cylinder 110 at this stage. Moreover, the outlet valve 304 of the first high-pressure cylinder 106 is positioned in a closed state to prevent gas from entering into the first low-pressure cylinder 102.

Still further, the second high-pressure piston 116 is positioned in an upper end position within the second high-pressure cylinder 114 and in a downward motion towards the lower end position therein. The inlet valve 306 and the outlet valve 308 are both positioned in a closed state and the second high-pressure cylinder 114 is in a power stroke, i.e. an ignition of the reduced volume within the second high-pressure cylinder takes place at this stage forcing the second high-pressure piston 116 downward towards the lower end position within the second high-pressure cylinder 114.

The second low-pressure piston 112 is positioned in a mid-portion of the second low-pressure cylinder 110 and is still in an upward motion towards the upper end position therein. Hence, the second low-pressure cylinder 140 is still in the compression stage which was initiated in the second stage of the cycle as described above. The outlet valve 316 of the second low-pressure cylinder 10 is positioned in an open state, thus allowing compressed gas to be forced out from the second low-pressure cylinder 110 and into the first high-pressure cylinder 106. The discharge valve 312 of the second low-pressure cylinder 110 is positioned in a closed state.

Figure 4D:
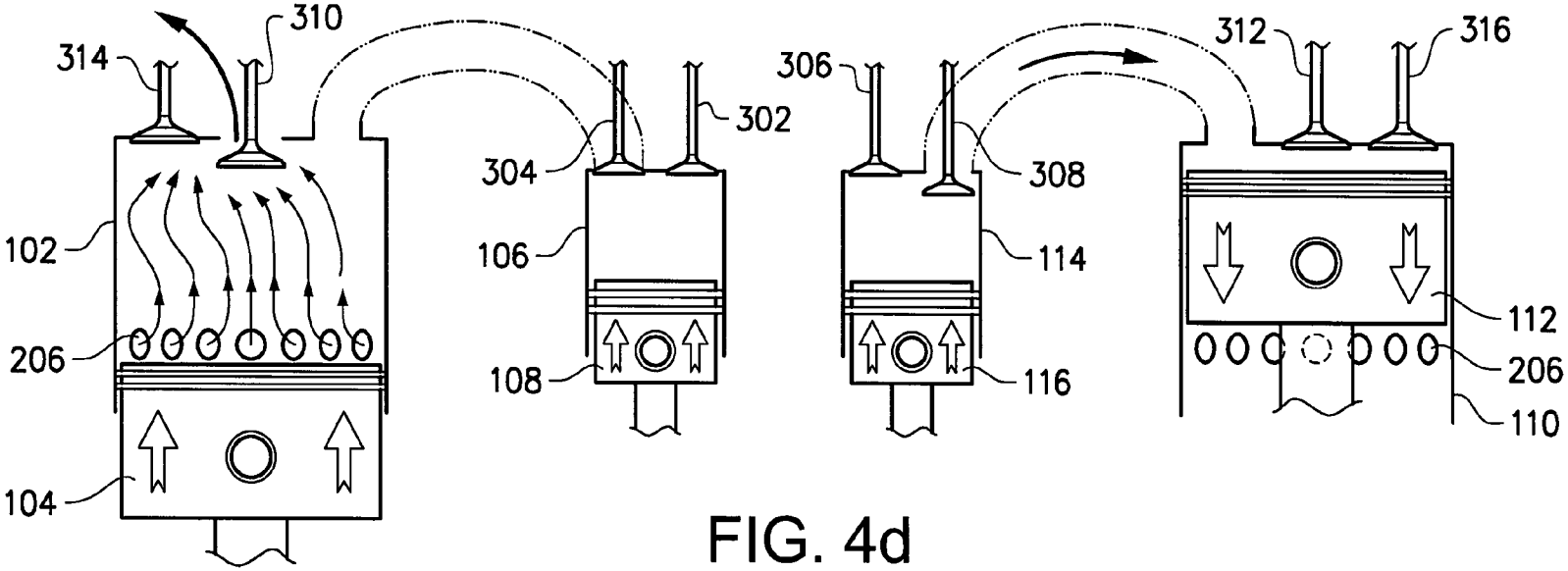

Finally, reference is made to FIG. 4*d* which illustrates the fourth and final stage of the cycle. The first low-pressure piston 104 is positioned in the lower end position of the first low-pressure cylinder 102 and in an upward motion towards the upper end position therein. The exhaust valve 310 of the first low-pressure cylinder 102 is positioned in an open state to allow expanded exhaust gas to be discharged from the first low-pressure cylinder 102. Also, the outlet valve 314 of the first low-pressure cylinder 102 is positioned in a closed state. Furthermore, the first low-pressure piston 104 is, as described, positioned in the lower end position of the first low-pressure cylinder 102. Hereby, the first low-pressure piston 104 is positioned below the liner intake ports 206 of the first low-pressure cylinder 102, thus allowing gas to enter therein. At this stage, the first low-pressure cylinder 102 is initiating a compression stage of the gas entering through the liner intake ports 206 and a scavenging process of the first low-pressure cylinder 102 is executed.

The first high-pressure piston 08 is positioned in the lower end position of the first high-pressure cylinder 106 and in an upward motion towards the upper end position therein. The inlet valve 302 and the outlet valve 304 are both positioned in a closed state such that the compressed gas received from the second low-pressure cylinder 110 in the third stage depicted in FIG. 4*c* will be further compressed during the upward motion of the first high-pressure piston 108.

The second high-pressure piston 116 is positioned in the lower end position of the second high-pressure cylinder 114 and in an upward motion towards the upper end position therein. The outlet valve 308 of the second high-pressure cylinder 114 is positioned in an open state, thus forcing the combustion gases from the second high-pressure cylinder 114 into the second low-pressure cylinder 110. Further, the inlet valve 306 of the second high-pressure cylinder 114 is positioned in a closed state.

Finally, the second low-pressure piston 112 is positioned in the upper end position of the second low-pressure cylinder 110 and in a downward motion towards the lower end position therein. The outlet valve 316 and the discharge valve 312 of the second low-pressure cylinder 110 are both positioned in a closed state. The second low-pressure cylinder 110 is in this stage receiving combustion gases from the second high-pressure cylinder 114. The second low-pressure cylinder 110 is in this fourth stage initiating the expansion phase and is thus acting as an expansion cylinder for the combustion gases received from the second high-pressure cylinder 114.

It is to be understood that the present invention is not limited to the embodiments described above and illustrated in the drawings; rather, the skilled person will recognize that many changes and modifications may be made within the scope of the appended claims. For example, the described opening and closing of the different valves is not strictly limited to the above description, the valve may be arranged in an opened state and in a closed state at either an earlier point in time in relation to the position of the respective piston, or later. Furthermore, it should be readily understood that the gas entering the first or second compression cylinders described above may, for example, be ambient air or other suitable gas.

The invention claimed is:

1. An internal combustion engine, comprising:

a first low-pressure cylinder housing a first low-pressure piston; and a first high-pressure cylinder housing a first high-pressure piston, the first high-pressure cylinder being arranged in upstream fluid communication with the first low-pressure cylinder for providing exhaust gas into the first low-pressure cylinder;

a second low-pressure cylinder housing a second low-pressure piston, the second low-pressure cylinder being arranged in upstream fluid communication with the first high-pressure cylinder for providing compressed gas into the first high-pressure cylinder; and a second high-pressure cylinder housing a second high-pressure piston, the second high-pressure cylinder being arranged in downstream fluid communication with the first low-pressure cylinder for receiving compressed gas from the first low-pressure cylinder, and further arranged in upstream fluid communication with the second low-pressure cylinder for providing exhaust gas into the second low-pressure cylinder.

2. The internal combustion engine according to claim 1, wherein the first and second low-pressure pistons operate in a two-stroke configuration and the first and second high-pressure pistons operate in a four-stroke configuration.

3. The internal combustion engine according to claim 1, wherein the first and second low-pressure pistons are connected to a first crank shaft and the first and second high-pressure pistons are connected to a second crank shaft, wherein the second crank shaft is configured to rotate with a speed of at least twice the speed of the first crank shaft.

4. The internal combustion engine according to claim 1, wherein the first low-pressure piston and the second low-pressure piston are arranged in a 180 degrees crank angle offset in relation to each other, such that the first low-pressure piston is configured to reach an upper end position within the first low-pressure cylinder when second low-pressure piston reaches a lower end position within the second low-pressure cylinder.

5. The internal combustion engine according to claim 1, wherein the first high-pressure piston and the second high-pressure piston are positioned to reach an upper end position within the respective high-pressure cylinder approximately simultaneously and in such a way that the first high-pressure piston is configured to be ignited at an upper end position within the first high-pressure cylinder when the second high-pressure piston is in an upper end position within the second high-pressure cylinder for initiation of intake of fuel therein.

6. The internal combustion engine according to claim 1, wherein the first and second high-pressure pistons are arranged to reach a lower end position within the respective first and second high-pressure cylinder when the first and second low-pressure pistons reaches an upper and a lower end position within the respective first and second low-pressure cylinder.

7. The internal combustion engine according to claim 1, wherein the first and second low-pressure cylinders are provided with liner intake ports at a lower end portion of the respective cylinders, such that gas can be provided into the respective low-pressure cylinder when the respective first and second low-pressure piston is positioned in their lower end position.

8. The internal combustion engine according to claim 1, wherein the first low-pressure cylinder is in fluid communication with the second high-pressure cylinder by means of a first passageway.

9. The internal combustion engine according to claim 1, wherein the second low-pressure cylinder is in fluid communication with the first high-pressure cylinder by means of a second passageway.

10. The internal combustion engine according to claim 8, wherein the second low-pressure cylinder is in fluid communication with the first high-pressure cylinder by means of a second passageway, and wherein each one of the first and second passageways is provided with cooling means for cooling the fluid passing there through.

11. The internal combustion engine according to claim 1, wherein the first high-pressure cylinder is in fluid communication with the first low-pressure cylinder by means of a third passageway.

12. The internal combustion engine according to claim 1, wherein the second high-pressure cylinder is in fluid communication with the second low-pressure cylinder by means of a fourth passageway.

13. The internal combustion engine according to claim 1, wherein each of the high-pressure cylinders comprises valved inlet ports and valved outlet ports for controlling fluid transportation into and out from the respective high-pressure cylinders.

14. The internal combustion engine according to claim 1, wherein each of the low-pressure cylinders comprises valved outlet ports arranged to control fluid transportation out from the respective low-pressure cylinders.

15. The internal combustion engine according to claim 13, wherein each of the valved inlet ports and valved outlet ports are controlled by means of a common cam shaft.

16. A vehicle comprising an internal combustion engine according to claim 1.

* * * * *